US009708894B2

(12) United States Patent
Ditzler

(10) Patent No.: US 9,708,894 B2
(45) Date of Patent: Jul. 18, 2017

(54) INERTIAL OCCLUSION RELEASE DEVICE

(71) Applicant: Christopher A. Ditzler, Parker, CO (US)

(72) Inventor: Christopher A. Ditzler, Parker, CO (US)

(73) Assignee: BAKER HUGHES INCORPORATED, Houston, TX (US)

( * ) Notice: Subject to any disclaimer, the term of this patent is extended or adjusted under 35 U.S.C. 154(b) by 293 days.

(21) Appl. No.: 14/470,463

(22) Filed: Aug. 27, 2014

(65) Prior Publication Data

US 2016/0061009 A1 Mar. 3, 2016

(51) Int. Cl.

| | |
|---|---|
| ***E21B 43/116*** | (2006.01) |
| ***E21B 43/26*** | (2006.01) |
| ***E21B 23/04*** | (2006.01) |

(52) U.S. Cl.

CPC ..... *E21B 43/116* (2013.01); *E21B 23/04* (2013.01); *E21B 43/26* (2013.01)

(58) Field of Classification Search

CPC ..... E21B 43/116; E21B 23/04; E21B 43/26; E21B 47/06; E21B 23/00; E21B 33/12; E21B 33/13

See application file for complete search history.

(56) References Cited

U.S. PATENT DOCUMENTS

| | | | |
|---|---|---|---|
| 6,003,607 | A | 12/1999 | Hagen et al. |
| 6,155,350 | A | 12/2000 | Melenyzer |
| 6,220,360 | B1 | 4/2001 | Connell et al. |
| 6,390,200 | B1 | 5/2002 | Allamon et al. |
| 6,802,372 | B2 | 10/2004 | Budde |
| 7,703,523 | B2 | 4/2010 | Wardley |
| 7,770,652 | B2 | 8/2010 | Barnett |
| 8,091,628 | B2 | 1/2012 | Peer et al. |

(Continued)

FOREIGN PATENT DOCUMENTS

| | | | |
|---|---|---|---|
| WO | 2015038095 | A1 | 3/2015 |
| WO | 2015038096 | A1 | 3/2015 |

(Continued)

OTHER PUBLICATIONS

Notification Concerning Transmittal of Copy of International Preliminary Report on Patentability; International Application No. PCT/US2015/042242; International Filing Date: Jul. 27, 2015; Date of Mailing: Mar. 9, 2017; pp. 1-12.

*Primary Examiner* — Wei Wang
(74) *Attorney, Agent, or Firm* — Cantor Colburn LLP

(57) ABSTRACT

In one aspect, an apparatus for use in a wellbore is disclosed, including an occlusion retaining mechanism; a rupture member associated with the occlusion retaining mechanism; an inertial member configured to puncture the rupture member in response an inertial event to release an occlusion from the occlusion retaining mechanism. In another aspect, a method for isolating a portion of a wellbore is disclosed, including providing a tubular in the wellbore; deploying a perforation gun in the tubular; deploying a frac plug in the wellbore; setting the frac plug in the wellbore; deploying a frac ball release tool associated with the perforation gun; selectively retaining a frac ball within the frac ball release tool; releasing the frac ball in response to an inertial event via an inertial member associated with the frac ball release tool.

19 Claims, 2 Drawing Sheets

(56) References Cited

U.S. PATENT DOCUMENTS

| | | | | |
|---|---|---|---|---|
| 2012/0037360 | A1* | 2/2012 | Arizmendi, Jr. ..... | E21B 23/04<br>166/250.01 |
| 2014/0083689 | A1 | 3/2014 | Streich et al. | |
| 2015/0068771 | A1 | 3/2015 | Richards et al. | |
| 2015/0068772 | A1 | 3/2015 | Richards et al. | |
| 2015/0136425 | A1 | 5/2015 | Burgos et al. | |
| 2015/0252642 | A1 | 9/2015 | Mailand et al. | |
| 2016/0123129 | A1 | 5/2016 | Sanchez et al. | |
| 2016/0222764 | A1 | 8/2016 | Rorvik | |

FOREIGN PATENT DOCUMENTS

| | | | |
|---|---|---|---|
| WO | 2015084342 | A1 | 8/2015 |
| WO | 2015138254 | A1 | 9/2015 |
| WO | 2016069747 | A1 | 5/2016 |

* cited by examiner

INERTIAL OCCLUSION RELEASE DEVICE

BACKGROUND

1. Field of the Disclosure

This disclosure relates generally to occlusion release devices that facilitate the selective release of an occlusion in response to an inertial event.

2. Background

Wellbores are drilled in subsurface formations for the production of hydrocarbons (oil and gas). Hydrocarbons are trapped in various traps or zones in the subsurface formations at different depths. Such zones are referred to as reservoirs or hydro-carbon bearing formations or production zones. In production zones, it is often desired to perform completion operations such as plugging and perforation to facilitate production within the production zones. During such completion operations an occlusion or frac ball can be utilized to isolate flow within a particular zone. It is often desired to deliver the occlusion with the deployment of a perforation gun used for perforation operations to minimize operation time and expense. During perforation operations, if the perforation gun fails, a replacement gun must be deployed within the wellbore, often requiring fluid flow to convey the perforation gun, particularly in horizontal wellbores. Such fluid flow may be impeded by an occlusion deployed before perforation operations. It is desired to deliver the occlusion after the perforation gun has fired.

The disclosure herein provides an occlusion release device that facilitates the selective release of an occlusion in response to an inertial event, such as the firing of a perforation gun.

SUMMARY

In one aspect, an apparatus for use in a wellbore is disclosed, including an occlusion retaining mechanism; a rupture member associated with the occlusion retaining mechanism; an inertial member configured to puncture the rupture member in response an inertial event to release an occlusion from the occlusion retaining mechanism.

In another aspect, a system for use in a wellbore is disclosed, including a tubular associated with the wellbore; a perforation gun deployed in the tubular; a frac plug deployed in the wellbore configured to receive a frac ball; a frac ball release tool, including a frac ball retaining mechanism; a rupture member associated with the frac ball retaining mechanism; an inertial member configured to puncture the rupture member in response an inertial event caused by the perforation gun to deploy the frac ball in the wellbore.

In another aspect, a method for isolating a portion of a wellbore is disclosed, including providing a tubular in the wellbore; deploying a perforation gun in the tubular; deploying a frac plug in the wellbore; setting the frac plug in the wellbore; deploying a frac ball release tool associated with the perforation gun; selectively retaining a frac ball within the frac ball release tool; releasing the frac ball in response to an inertial event via an inertial member associated with the frac ball release tool.

Examples of the more important features of certain embodiments and methods have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
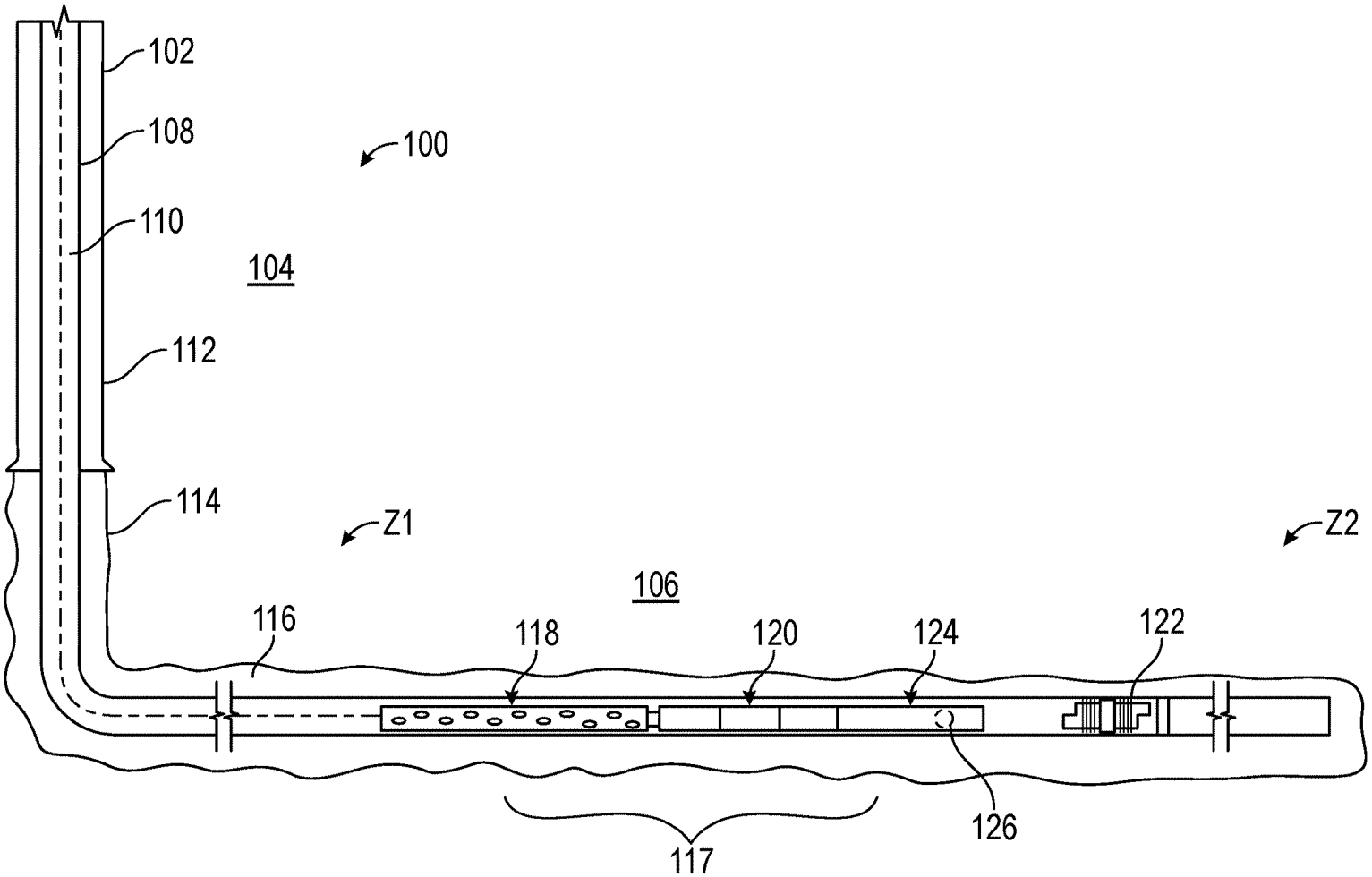
FIG. 1 shows an exemplary wellbore system that includes a occlusion release device, according to one non-limiting embodiment of the disclosure.

FIG. 1 is a line diagram of a wellbore system 100 that may be used for completion operations in a formation 104 with multiple production zones Z1, Z2, etc. In an exemplary embodiment, the system includes a casing 112 cemented in wellbore 102 formed in a formation 104. In certain embodiments, wellbore 102 is cemented with cement 116 in an open hole 114 without casing 112. Tubing or tubular 108 is deployed within wellbore 102 to a downhole location 106. In certain embodiments, downhole location 106 and zones Z1, Z2 are in horizontal or near horizontal orientations.

During completion operations, such as "plug and perforation" operations, a perforation gun 118, frac plug setting tool 120 and a ball releasing tool 124 are deployed as bottom hole assembly (BHA) 117 to a downhole location 106 in a zone Z1, Z2, etc. In an exemplary embodiment, the BHA 117 is deployed via wireline 110. In alternative embodiments, the BHA 117 is deployed via coiled tubing. The frac plug setting tool 120 sets the frac plug 122 within tubing 108, wherein the frac plug 122 allows for a flow therethrough when unobstructed.

The perforation gun 118 is fired in a downhole location 106. After the perforation gun 118 is fired and perforations are created at a downhole location 106, the ball releasing tool 124 releases an occlusion, such as ball 126 into frac plug 122 to stop fluid flow beyond the plugged area to allow completion operations, such as fracing. During completion operations, it is desirable to deploy ball 126 into frac plug 122 after the perforation gun 118 has successfully created perforations at the downhole location 106. In order to deploy the ball 126 under the desired conditions, ball releasing tool 124 is utilized to selectively release the ball 126. A non-limiting embodiment of a ball releasing tool 124 is described in reference to FIG. 2.

Figure 2:
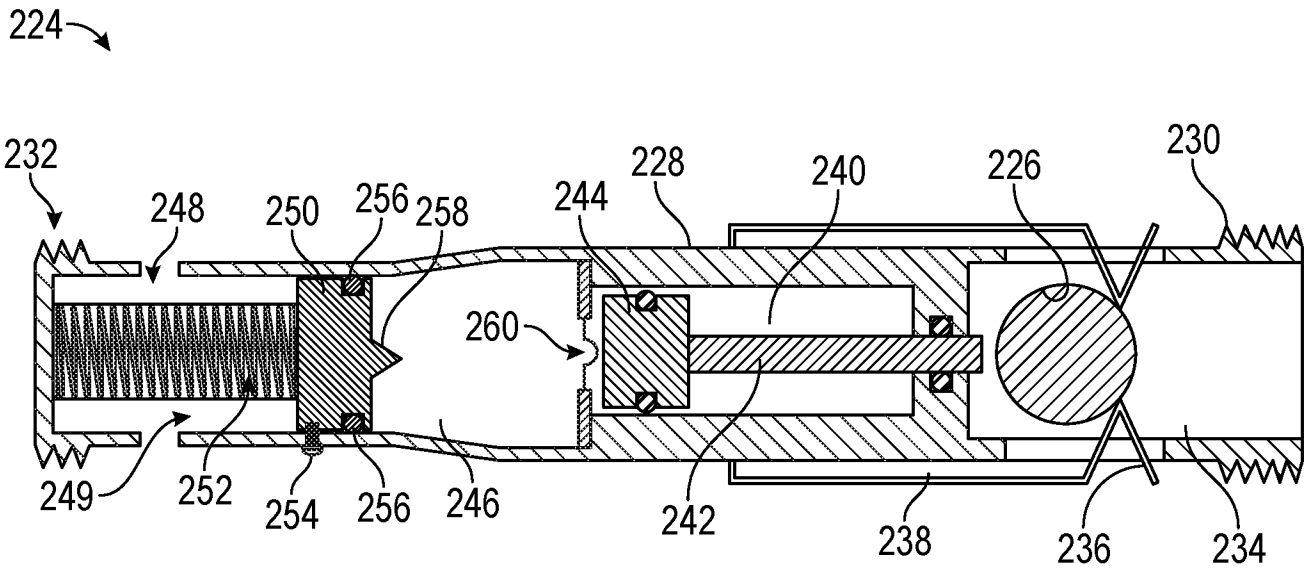
FIG. 2 shows a non-limiting embodiment of an occlusion release device for use in a wellbore system, including the wellbore system shown in FIG. 1, for deployment in a wellbore, such as wellbore shown in FIG. 1.

FIG. 2 shows a cross-sectional view of a non-limiting embodiment of a ball releasing tool for use in a wellbore system, including the wellbore system shown in FIG. 1 for deployment in a wellbore, such as wellbore shown in FIG. 1. The ball releasing tool 224 includes body 228, ball chamber 234, drive piston 244, and hammer sub 250.

Body 228 includes an upper connection 232 and a lower connection 230. Upper connection 232 and lower connection 230 allow body 228 of ball releasing tool 214 to be assembled with other components in BHA 117 that may be deployed down hole together. In an exemplary embodiment, ball releasing tool 224 is coupled via upper connection 232 with BHA 117 to perforation gun 118 and frac plug setting tool 120. Advantageously, this coupling allows for a single deployment for plugging operations, perforation operations, and ball release applications, minimizing time and expense.

In an exemplary embodiment, port 248 receives fluid flow 249 from wellbore 102. After an inertial event, such as the successful firing of perforation gun 118, pressure, fluid and inertial signals are communicated within tool 224. Inertial information is received by hammer sub 250, acting as an inertial member. In certain embodiments, fluid flow 249 is received by hammer sub 250. Force may be imparted on hammer sub 250 from inertial events, pressure, and spring 252. In an exemplary embodiment, hammer sub 250 is associated with body 228 via spring 252. Spring 252 provides enough force to allow hammer sub 250 to reach and puncture rupture disk 260.

In an exemplary embodiment, hammer sub 250 is selectively retained by shear screw 254. Shear screw 254 may retain hammer sub 250 until a minimum predetermined force is applied, retaining hammer sub 250 until an selected force or a corresponding inertial event (such as perforation guns 118 firing) has occurred. In certain embodiments, shear screw 254 is selected to resist certain inertial events, such as the activation of frac plug setting tool 120, to avoid undesired release of hammer sub 250. Shear screw 254 may then release allowing hammer sub 250 to travel towards rupture disk 260.

In an exemplary embodiment, hammer sub 250 includes a sealing O-ring 256 in sealing relationship with the body 228. O-ring 256 allows wellbore fluid 249 to be retained on one side of the hammer sub 250. As the hammer sub 250 is moved toward the lower extent of the tool 224, fluid flow 249 may continue beyond O-ring 256.

When sufficient force is met, hammer sub 250 reaches rupture disk 260. In an exemplary embodiment, hammer sub 250 includes a pin 258 to pierce rupture disk 260. The piercing of rupture disk 260 allows for wellbore fluid flow 249 to enter the upper chamber 246 of the ball release tool 224.

Drive piston 244 receives wellbore fluid in an upper chamber 246. The pressure differential between upper chamber 246 and lower chamber 240 causes fluid pressure on drive piston 244 to urge drive piston 244 toward a lower extent of ball release tool 224. As the drive piston 244 is urged downwardly, the drive shaft 242 pushes frac ball 226 against the force of the retainers 236 and retainer springs 238.

Until selectively released, frac ball 226 is selectively retained within an occlusion retaining mechanism, such as ball chamber 234. In an exemplary embodiment, frac ball 226 is retained by retainers 236 within ball chamber 234. Retainer springs 238 generally urge retainers 236 inward to keep frac ball 226 within ball chamber 234. The retainer springs 238 are selected to allow the force of the springs to be selectively overcome, without allowing frac ball 226 to be inadvertently deployed.

When the force of retainer springs 238 is overcome, the frac ball 226 is pushed out of the ball chamber 234 to be deployed in the wellbore 102. The frac ball 226 is then seated in a frac plug 122 when desired.

Advantageously, ball release tool 224 allows for frac ball 226 to be delivered during frac plug setting and perforation operations, saving operation time and expense. Further, ball release tool 224 allows for the redeployment of BHA 117 in the event of perforation gun 118 failures, particularly in horizontal wellbores.

Therefore, in one aspect, an apparatus for use in a wellbore is disclosed, including an occlusion retaining mechanism; a rupture member associated with the occlusion retaining mechanism; an inertial member configured to puncture the rupture member in response an inertial event to release an occlusion from the occlusion retaining mechanism. In certain embodiments, the apparatus includes a spring associated with the inertial member. In certain embodiments, the apparatus includes an inertial member retainer configured to retain the inertial member until a predetermined force is applied. In certain embodiments, the apparatus includes a sealing member associated with the inertial member. In certain embodiments, the apparatus includes a port associated with the inertial member. In certain embodiments, the apparatus includes a piercing member associated with the inertial member.

In another aspect, a system for use in a wellbore is disclosed, including a tubular associated with the wellbore; a perforation gun deployed in the tubular; a frac plug deployed in the wellbore configured to receive a frac ball; a frac ball release tool, including a frac ball retaining mechanism; a rupture member associated with the frac ball retaining mechanism; an inertial member configured to puncture the rupture member in response an inertial event caused by the perforation gun to deploy the frac ball in the wellbore. In certain embodiments, the system includes a spring associated with the inertial member. In certain embodiments, the system includes an inertial member retainer configured to retain the inertial member until a predetermined force is applied. In certain embodiments, the system includes a sealing member associated with the inertial member. In certain embodiments, the system includes a port associated with the inertial member. In certain embodiments, the system includes a piercing member associated with the inertial member. In certain embodiments, the frac ball is configured to be set in the frac plug. In certain embodiments, the system includes a frac plug setting tool associated with the perforation gun. In certain embodiments, the system includes at least one of a wireline or a coiled tubing configured to convey the perforation gun.

In another aspect, a method for isolating a portion of a wellbore is disclosed, including providing a tubular in the wellbore; deploying a perforation gun in the tubular; deploying a frac plug in the wellbore; setting the frac plug in the wellbore; deploying a frac ball release tool associated with the perforation gun; selectively retaining a frac ball within the frac ball release tool; releasing the frac ball in response to an inertial event via an inertial member associated with the frac ball release tool. In certain embodiments, the method includes rupturing a rupture member associated with the frac ball release tool via the inertial member; and providing a wellbore fluid flow to communicate with a drive member of the frac ball release tool. In certain embodiments, the method includes firing the perforation gun to provide the inertial event. In certain embodiments, the method includes selectively retaining the inertial member prior to the inertial event. In certain embodiments, the method includes piercing the rupture member via a piercing member associated with the inertial member.

The invention claimed is:

1. An apparatus for use in a wellbore, comprising:

an occlusion retaining mechanism to retain an occlusion within a chamber of the apparatus;

a rupture member associated with the occlusion retaining mechanism;

an inertial member configured to puncture the rupture member in response an inertial event to release the occlusion from the occlusion retaining mechanism to deploy the occlusion from the apparatus into the wellbore.

2. The apparatus of claim 1, further comprising a spring associated with the inertial member.

3. The apparatus of claim 1, further comprising an inertial member retainer configured to retain the inertial member until a predetermined force is applied.

4. The apparatus of claim 1, further comprising a sealing member associated with the inertial member.

5. The apparatus of claim 1, further comprising a port associated with the inertial member.

6. The apparatus of claim 1, further comprising a piercing member associated with the inertial member.

7. A system for use in a wellbore, comprising:

a tubular associated with the wellbore;

a perforation gun deployed in the tubular;

a frac plug deployed in the wellbore configured to receive a frac ball;

a frac ball release tool, comprising:

a frac ball retaining mechanism to retain the frac ball within a chamber of the frac ball release tool;

a rupture member associated with the frac ball retaining mechanism;

an inertial member configured to puncture the rupture member in response an inertial event caused by the perforation gun to deploy the frac ball from the frac ball release tool into the wellbore.

8. The system of claim 7, further comprising a spring associated with the inertial member.

9. The system of claim 7, further comprising an inertial member retainer configured to retain the inertial member until a predetermined force is applied.

10. The system of claim 7, further comprising a sealing member associated with the inertial member.

11. The system of claim 7, further comprising a port associated with the inertial member.

12. The system of claim 7, further comprising a piercing member associated with the inertial member.

13. The system of claim 7, wherein the frac ball is configured to be set in the frac plug.

14. The system of claim 7, further comprising a frac plug setting tool associated with the perforation gun.

15. The system of claim 7, further comprising at least one of a wireline or a coiled tubing configured to convey the perforation gun.

16. A method for isolating a portion of a wellbore, comprising:

providing a tubular in the wellbore;

deploying a perforation gun in the tubular;

deploying a frac plug in the wellbore;

setting the frac plug in the wellbore;

deploying a frac ball release tool associated with the perforation gun;

selectively retaining a frac ball within the frac ball release tool to retain the frac ball within a chamber of the frac ball release tool;

rupturing a rupture member associated with the frac ball release tool via an inertial member;

providing a wellbore fluid flow to communicate with a drive member of the frac ball release tool; and deploying the frac ball from the frac ball release tool into the wellbore in response to an inertial event via the inertial member associated with the frac ball release tool.

17. The method of claim 16, further comprising firing the perforation gun to provide the inertial event.

18. The method of claim 16, further comprising selectively retaining the inertial member prior to the inertial event.

19. The method of claim 16, further comprising piercing the rupture member via a piercing member associated with the inertial member.

* * * * *